US005611490A

United States Patent [19]

Barriac et al.

[11] Patent Number: 5,611,490

[45] Date of Patent: Mar. 18, 1997

[54] FOAMER ASSEMBLY FOR FLUID DISPENSER

[75] Inventors: Jacques J. Barriac, Claremont; Adonis Spathias, Corona, both of Calif.

[73] Assignee: Calmar Inc., City of Industry, Calif.

[21] Appl. No.: 358,938

[22] Filed: Dec. 19, 1994

[51] Int. Cl.[6] ..... B05B 1/02

[52] U.S. Cl. ..... 239/333; 239/428.5; 239/504

[58] Field of Search ..... 239/504, 343, 239/333, 428.5

[56] References Cited

U.S. PATENT DOCUMENTS

| | | | |
|---|---|---|---|
| 2,532,565 | 12/1950 | Miller . | |
| 2,645,292 | 7/1953 | Williams . | |
| 3,388,868 | 6/1968 | Watson et al. . | |
| 4,047,668 | 9/1977 | De Weese et al. | 239/504 |
| 4,219,159 | 8/1980 | Wesner | 239/333 |
| 4,603,812 | 8/1986 | Stoesser et al. . | |
| 4,733,818 | 3/1988 | Aghnides . | |
| 4,768,717 | 9/1988 | Shay . | |
| 4,830,790 | 5/1989 | Stevenson . | |
| 4,925,106 | 5/1990 | Maas et al. | 239/504 |
| 5,275,763 | 1/1994 | Fakai . | |

FOREIGN PATENT DOCUMENTS

| | | | |
|---|---|---|---|
| 1072206 | 5/1957 | Germany | 239/428.5 |
| 2012606 | 9/1970 | Germany . | |

*Primary Examiner*—Matthew C. Graham
*Attorney, Agent, or Firm*—Watson Cole Stevens Davis, P.L.L.C.

[57] ABSTRACT

A foamer nozzle assembly has dual screens of intersecting strands in spaced sets of strands, the strands of one set being offset relative to the strands of the other set for establishing two turbulence zones as the flow direction of spray particles is deflected when passing through the first screen and as the flow direction of the spray particles is further deflected when passing through the second screen. The screens are located in a cylinder of the assembly which may or may not define a turbulence cylinder depending on the spacing of the screens from the discharge orifice. The screens may be spaced apart a given distance to establish a turbulence zone therebetween.

12 Claims, 2 Drawing Sheets

FOAMER ASSEMBLY FOR FLUID DISPENSER

RELATED APPLICATION

This is application relates to Ser. No 08/392,392 filed Feb. 22, 1995 as a continuation of Ser. No. 08/352,805, filed Dec. 1, 1994, and now abandoned entitled Foamer Nozzle Assembly For Trigger Sprayer, commonly owned herewith.

BACKGROUND OF THE INVENTION

This invention relates to foamer nozzles for fluid dispensers, and more particularly to a foamer nozzle assembly having a dual screen establishing at least two turbulence zones for creating foam.

Known trigger sprayers have foam generating devices of various types. Some foamers, while producing a reasonably acceptable foam quality, also introduce a large amount of airborne droplets into the atmosphere producing vapor which may cause severe burning of the nose, mouth and eyes especially when dispensing household cleaning product formulations in small enclosed spaces. Other foamers are known to reduce the amount of airborne particles but do not produce an acceptable foam.

One trigger operated foam generating sprayer is disclosed in U.S. Pat. No. 4,603,812. As therein disclosed a foam-forming device includes a wire mesh screen retained in the path of the spray such that substantially all the spray passes through the foam forming device without contact except by the screen.

A foamer nozzle disclosed in U.S. Pat. No. 4,768,717 has a wire mesh screen disc in combination with a turbulence chamber to enhance the foam-producing capabilities of the nozzle.

A foam nozzle assembly disclosed in U.S. Pat. No. 4,925,106 has a perforated wall in Combination with a foam generating chamber, the wall having arcuately spaced apart diameter ribs and at least two concentric circular ribs defining arcuate partially circular slot segments. The back edges of the diameter ribs and the circular ribs facing into the inner cavity are rounded to provide an irregular curved surface against which spray of liquid can impinge and scatter to mix with air and form foam in the foam generating chamber.

A foam device disclosed in U.S. Pat. No. 4,219,159 has a pair of wire mesh screens in combination with an aspirating chamber, a foam forming cylindrical chamber coaxial with the aspirating chamber, a short expansion chamber, and a third coaxial chamber.

Other non-trigger actuated pump sprayers have foam forming screens for generating foam.

SUMMARY OF THE INVENTION

It is an object of the present invention to provide a foamer assembly for a fluid dispenser which significantly reduces the amount of airborne droplets into the atmosphere while at the same time creates an acceptable quality foam which does not dribble when applied to the target and which has an acceptable hang time on the target.

A further object is to provide such a foamer assembly having a pair of spaced mesh screens each of a size of about 15 to 60 openings per linear inch, the screens being relatively offset in at least one direction to establish a pair of turbulence zones as the flow direction of the spray particles is deflected when passing through the first screen and as the flow direction of the spray particles is further deflected when passing through the second screen.

The dual mesh screens can be provided in combination with a turbulence cylinder located upstream of the mesh screens, downstream of the mesh screens or intermediate the mesh screens. In addition, turbulence zones Can be provided both upstream and intermediate the mesh screens, or the mesh screens can be provided without a turbulent cylinder in combination.

The mesh screens may be of molded plastic construction and may have flat surfaces confronting the spray particles. The screens may be formed of intersecting strands of trapezoidal section.

Other objects, advantages and novel features of the invention will become more apparent from the following detailed description of the invention when taken in conjunction with the accompanying drawings.

DETAILED DESCRIPTION OF THE INVENTION

Figure 1:
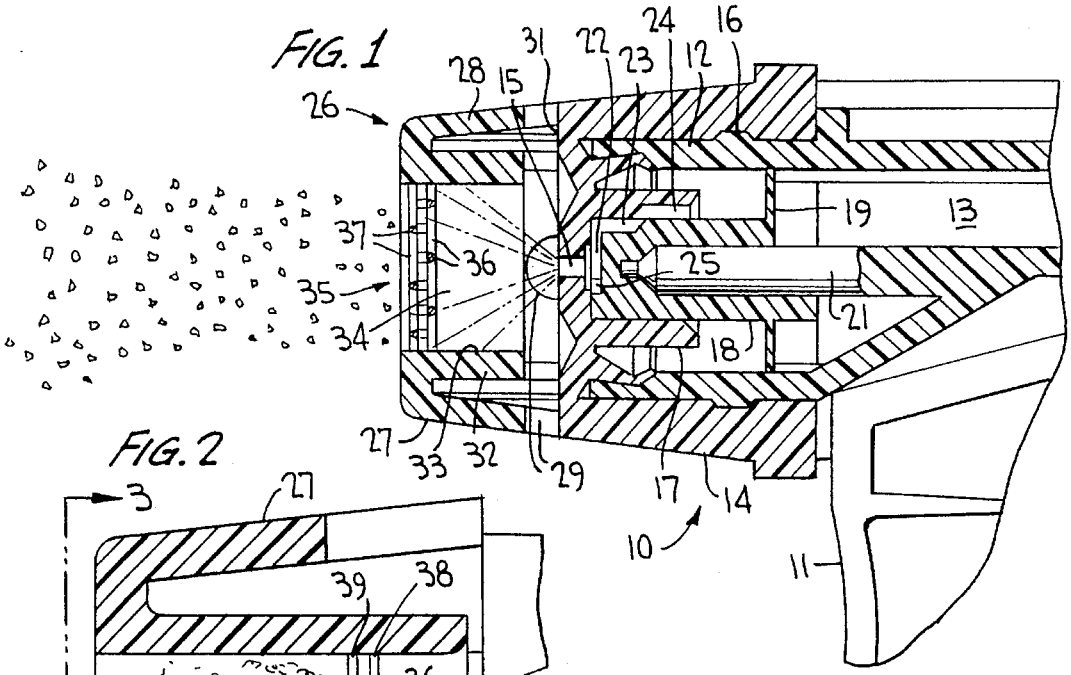
FIG. 1 is a vertical sectional view of one embodiment of the foamer assembly of the invention mounted at the discharge end of a fluid dispenser and as a trigger sprayer.

Turning now to the drawings wherein like reference characters refer to like and corresponding parts throughout the several views, a fluid dispenser in the form of a trigger pump sprayer generally designated 10 is shown in FIG. 1 of known construction as having a trigger actuator 11 and a discharge end 12 into which liquid product flows through a discharge passage 13 upon pumping operation.

A rotatable nozzle cap 14 having a central discharge orifice 15 is snap fitted about the discharge end as at 16. The cap has an internal sleeve 17 in engagement with a probe cap 18 carrying an annular discharge flap valve 19. The probe cap is fixed to the end of a probe 21, and has a swirl chamber 22 formed at its outer end. Longitudinal grooves 23 and 24 on the probe cap and sleeve 17 are aligned upon relative rotation of the nozzle cap for admitting liquid product via the discharge valve through tangential channels 25 into the swirl chamber upon pumping action of the sprayer for inducing a swirl to the product to issue through the discharge orifice as a conical spray having a given subtended angle.

Foamer nozzle assembly 26 according to the invention includes a foamer cap 27 having an outer skirt 28 formed with air aspiration openings 29, and a plurality of snap-lock legs (not shown) extending from skirt 28 for snapping into suitable openings (not shown) located in end wall 31 of nozzle cap 14 which contains discharge orifice 15. Such a snap fit arrangement is illustrated in U.S. application Ser. No. 08/207,610, now U.S. Pat. No. 5,366, 160 commonly owned herewith.

The foamer cap has an inner cylinder 32 coaxial with the discharge orifice, the cylinder having a smooth inner wall 33 terminating at its upstream end a predetermined distance from end wall 31. In the FIG. 1 embodiment, cylinder 32 defines a turbulence chamber 34 establishing a first turbulence zone such that, during pumping, the conical spray particles are deflected upon impact against inner wall 33 of the turbulence chamber thereby creating and concentrating a foam as the spray particles mix with air in the turbulence chamber as aspirated through air openings 29.

In the FIG. 1 embodiment, foam enhancement means generally designated 35 comprise intersecting strands 36 and intersecting strands 37 located in cylinder 32 for further generating foam as the spray particles pass through the strands. A first set 38 of such strands lie in a first plane and define a relatively coarse mesh screen having a size of about 15 to 60 openings per linear inch (see FIG. 3). A second set 39 of intersecting strands 37 lie in a second plane parallel to and spaced from the first plane and define another relatively coarse mesh screen having a size of about 15 to 40 openings per linear inch.

The mesh screens are shown relatively offset in two directions (x and y) perpendicular to wall 33, although the relative offset of the screens may be in only the x or in only the y direction, without departing from the invention.

Figure 3:
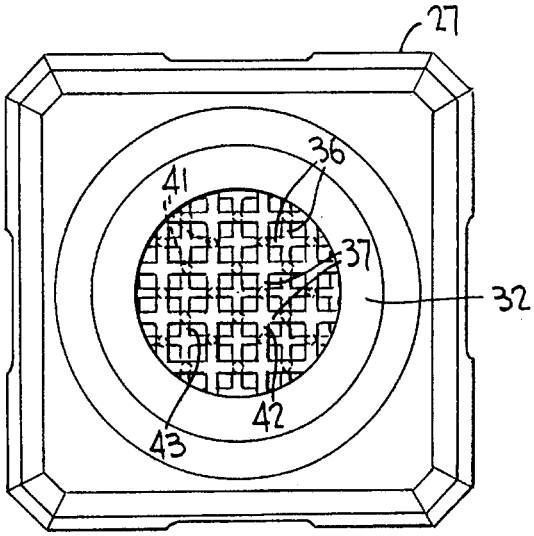
FIG. 3 is a view taken substantially along the line of 3—3 of FIG. 2.

As shown in FIG. 3, the relative offsetting of the screens, in one or both the x and y directions, results in a net effective mesh size through both screens of about 30 to 80 openings per linear inch.

The first set 38 of intersecting strands (first mesh) establishes a second turbulence zone as the spray particles impacting against the intersecting strands deflect and change direction while passing through the coarse openings thereof. The relatively offset intersecting strands of second set 39 (second mesh) establishes a third turbulence zone as the flow direction of the spray particles exiting the coarse openings of the first mesh again change direction as the particles deflect upon impact against the intersecting strands of the second mesh while passing through the coarse openings thereof. The turbulence created upon such non-uniform movement of flow through foam enhancement means 35 further breaks up the spray foam particles first created in the turbulence cylinder (first turbulence zone) and exit the downstream end of the foamer nozzle assembly as a fine highly textured foam of acceptable foam quality containing a significantly reduced amount of airborne particles.

Intersecting strands 36 and intersecting strands 37 may be of molded plastic construction molded together with nozzle cap 27. The first and second sets of the parallel and relatively spaced apart strands may be interconnected during the molding process by thin columns 41 disposed perpendicular to the first and second planes containing the first and second sets of strands, and located at those junctures at which strands 37 overlie strands 36 (FIG. 3).

As shown in the drawings, the upstream surfaces of both sets of intersecting strands may be flat such that the spray/foam particles impacting against the flat surfaces of the strands are deflected upon flow through coarse openings 42 and are further deflected upon movement through coarse openings 43 in an abrupt manner for establishing the turbulence zones for enhancing foaming. Also, the intersecting strands of both sets may be trapezoidal in section such that the opposing sidewalls of the strands of set 38 diverge, and the opposing sidewalls of the strands of set 39 converge for enhancing the non-uniform motion of flow through both screens.

Figure 2:
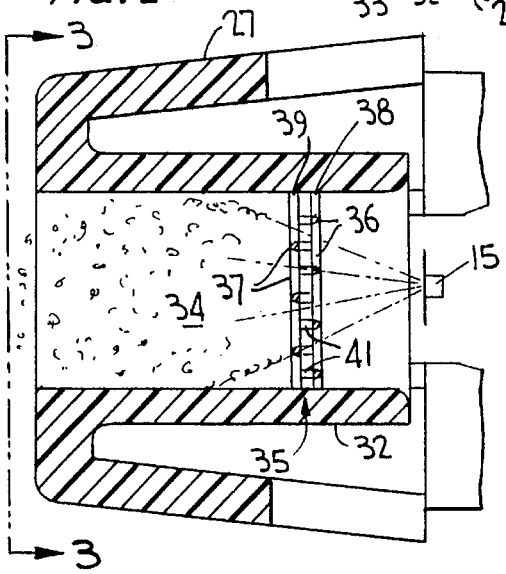
FIG. 2 is a vertical sectional view of the nozzle assembly according to another embodiment of the invention.

In the FIG. 2 embodiment, the foam enhancement means 35 can be spaced closer to discharge orifice 15 such that the conical spray first passes through the second turbulence zone (established by set 38), continues through the third turbulence zone (established by set 39) and flows into the first turbulence zone established by turbulence chamber 34 in which the spray/foam particles impact against the smooth inner wall of the chamber to form a high quality foam. Thus the turbulence zones are established in second, third and first zones in succession in FIG. 2, and are established in first, second and third zones in succession in FIG. 1.

Figure 4:
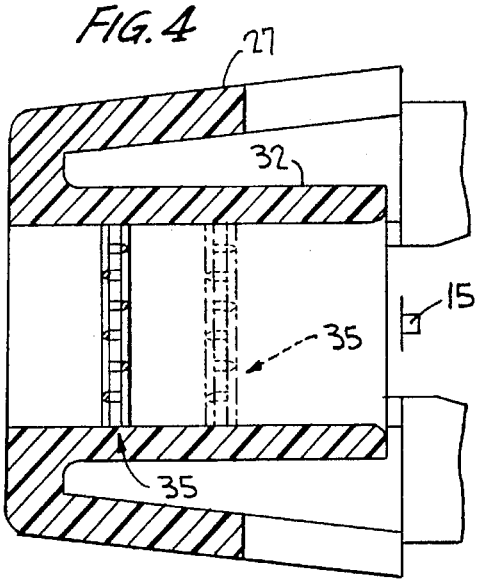
FIG. 4 is a view similar to FIG. 2 of another embodiment of a foamer nozzle according to the invention.

As shown in FIG. 4, foam enhancement means 35 can be located at different spacings from discharge orifice 15 to create different combinations of turbulence zones in combination with turbulence chamber 34.

Figure 5:
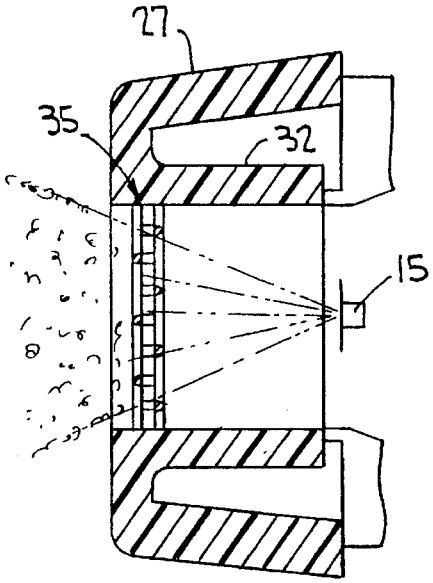
FIG. 5 is a view similar to FIG. 4 of yet another embodiment of a foamer nozzle according to the invention.

In FIG. 5, the foam enhancement means 35 is spaced a predetermined distance from orifice 15 such that the spray particles pass only through the two sets of strands such that cylinder 32 does not function as a turbulence cylinder.

Figure 6:
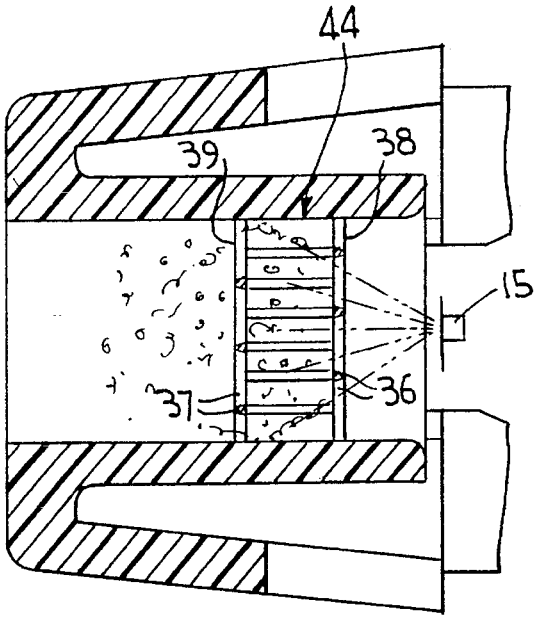
FIG. 6 is a view similar to FIG. 4 of still another embodiment of a foamer nozzle according to the invention.

Another embodiment of the invention shown in FIG. 6 includes a foam enhancement means 44 comprising the same two sets 38 and 39 of intersecting strands 36 and 37 spaced farther apart from one another compared to that shown in FIG. 1, and spaced relatively closer to the discharge orifice. With such an arrangement, the first turbulence zone established by the turbulence chamber is intermediate the second turbulence zone established by the first mesh 38, and the third turbulence zone established by second mesh 39. The second, first and third turbulence zones are therefore established in succession. The spray particles are directed through the coarse openings 43 in set 38, are deflected in changed direction.

Figure 7:
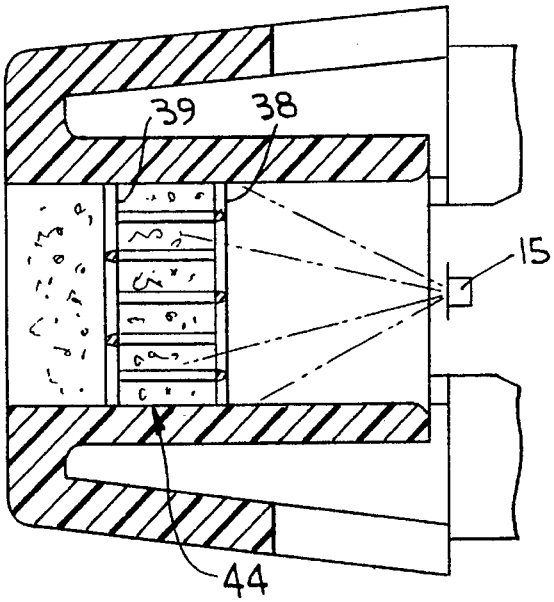
FIG. 7 is a view similar to FIG. 6 of still another embodiment of a foamer nozzle according to the invention.

In the FIG. 7 embodiment, means 44 is spaced a further distance from orifice 15 compared to that of FIG. 6 for establishing a first turbulence zone upstream of means 44, a second turbulence zone (38), a fourth turbulence zone (between sets 38 and 39), and a third turbulence zone (set 39). The first, second, fourth, and third zones are therefore established in succession.

Obviously, many other modifications and variations of the present invention are made possible in the light of the above teachings. For example, the foamer nozzle assembly is not restricted to a trigger sprayer as illustrated but is likewise adopted for other non-trigger actuated fluid dispensers as well, without departing from the invention. It is therefore to be understood that within the scope of the appended claims the invention may be practiced otherwise than as specifically described.

What is claimed is:

1. A foamer nozzle assembly mounted at a discharge end of a fluid dispenser, comprising, a cylinder having a smooth inner wall defining a first turbulence zone coaxial with a discharge orifice located in an end wall at said discharge end through which a conical spray is discharged in a downstream direction into said cylinder for generating foam as spray particles deflect upon impact against said smooth inner wall to mix with air in said chamber to create bubbles of foam, foam enhancement means comprising a first set of intersecting strands and a second set of intersecting strands located in said cylinder for further generating foam as the spray particles pass through said means, said first set of said strands lying in a first plane and mutually intersecting to define a mesh screen of rectangular openings having a size of about 15 to 60 opening per linear inch, said second set of said strands lying in a second plane parallel to and spaced from said first plane in said downstream direction, said second set of strands mutually intersecting to define a mesh screen of rectangular openings having a size of about 15 to 60 openings per linear inch, said mesh screens being relatively offset in at least one direction perpendicular to said inner wall to define a combined mesh screen of rectangular openings having a size greater than 15 to 60 openings per linear inch in said one direction, and to establish second and third turbulence zones as the flow direction of the spray particles is deflected when passing through said first set and as the flow direction of the spray particles is further deflected when passing through said second set.

2. The foamer nozzle assembly according to claim 1, wherein said first and second sets are spaced apart a predetermined distance from one another and are together spaced a predetermined distance from said orifice to establish said first, second and third turbulence zones in succession in said downstream direction.

3. The foamer nozzle assembly according to claim 2, wherein the offset in each of said two directions is approximately equal to one-half the size of said openings of either of said mesh screen.

4. The foamer nozzle assembly according to claim 1, wherein said first and second sets are spaced apart a predetermined distance from said orifice to establish said second, first and third zones in succession in said downstream direction.

5. The foamer nozzle assembly according to claim 1, wherein said first and second sets are spaced apart a predetermined distance from one another and are together spaced a predetermined distance from said orifice to establish said second, third and first zones in succession in said downstream direction.

6. The foamer nozzle assembly according to claim 1, wherein said first and second sets are together spaced apart a predetermined distance from said orifice and are spaced apart a predetermined distance from one another to establish a fourth turbulence zone therebetween comprising said smooth inner wall against which said spray particles impact for establishing said first, second, fourth and third turbulence zones in succession in said downstream direction.

7. The foamer nozzle assembly according to claim 1, wherein said first and second sets of said strands are of molded plastic construction.

8. The foamer nozzle assembly according to claim 1, wherein said strands of said first and second sets have flat surfaces on upstream sides thereof lying perpendicular to said inner wall.

9. The foamer nozzle assembly according to claim 8, wherein said strands of said first and second sets are trapezoidal in cross-section.

10. The foamer nozzle assembly according to claim 9, wherein opposing sidewalls of said strands of said first set diverging in said downstream direction, and opposing sidewalls of said strands of said second set converging in said downstream direction.

11. The foamer nozzle assembly according to claim 1, wherein the offset in said at least one direction is approximately equal to one-half the size of said openings of either of said mesh screen.

12. The foamer nozzle assembly according to claim 1, wherein said mesh screens are relatively offset in two directions perpendicular to said inner wall to define the combined mesh screen of rectangular openings having a size greater than 15 to 60 openings per linear inch in said two directions.

* * * * *